US005218155A

United States Patent [19]

Saito

[11] Patent Number: 5,218,155

[45] Date of Patent: Jun. 8, 1993

[54] TONE SIGNAL PROCESSING APPARATUS FOR PCM WAVEFORM INTERPOLATION AND FILTERING

[75] Inventor: Tsutomu Saito, Iwata, Japan

[73] Assignee: Kabushiki Kaisha Kawai Gakki Seisakusho, Shizuoka, Japan

[21] Appl. No.: 677,249

[22] Filed: Mar. 29, 1990

[30] Foreign Application Priority Data

Mar. 30, 1990 [JP] Japan ..... 2-84578

[51] Int. Cl.[5] ..... G10H 7/00; G10H 1/06

[52] U.S. Cl. ..... 84/623; 84/661; 84/DIG. 9; 84/607

[58] Field of Search ..... 84/603, 607, 608, 622, 84/623, 647, 659, 661, DIG. 9

[56] References Cited

U.S. PATENT DOCUMENTS

| | | | |
|---|---|---|---|
| 4,036,096 | 7/1977 | Tomisawa et al. | 84/607 |
| 4,548,119 | 10/1985 | Wachi et al. | 84/DIG. 9 X |
| 4,554,858 | 11/1985 | Wachi et al. | 84/DIG. 9 X |
| 4,638,706 | 1/1987 | Nagashima et al. | 84/623 |
| 4,646,612 | 3/1987 | Suzuki | 84/607 |
| 4,715,257 | 12/1987 | Hoshiai et al. | 84/603 |
| 4,815,354 | 3/1989 | Kunimoto | 84/622 |
| 4,841,828 | 6/1989 | Suzuki | 84/622 |
| 4,907,484 | 3/1990 | Suzuki et al. | 84/661 |
| 5,007,323 | 4/1991 | Usami | 84/607 |
| 5,113,740 | 5/1992 | Saito | 84/607 |

*Primary Examiner*—William M. Shoop, Jr.
*Assistant Examiner*—Jeffrey W. Donels

[57] ABSTRACT

A tone signal processing apparatus for time-divisionally reading out tone signal waveforms in units of different channels from a waveform memory for storing a plurality of kinds of tone signal waveforms each consisting of tone data at a plurality of sampling points. An arithmetic circuit for multiplying each of two input data with a predetermined coefficient, and adding the products, and a memory circuit for storing an output from the arithmetic circuit are arranged. The arithmetic circuit is alternately operated in two arithmetic modes, i.e., an interpolation arithmetic mode for multiplying each of two tone data at adjacent sampling points read out from the waveform memory with an interpolation coefficient, and adding the products to obtain an interpolated value obtained by interpolating between the adjacent sampling points, and a filter arithmetic mode for multiplying each of the interpolated value and a previous filter output obtained from the filter circuit with a filter coefficient to obtain a filter output. The filter coefficient is changed in units of channels to provide different filter characteristics in units of channels.

10 Claims, 4 Drawing Sheets

TONE SIGNAL PROCESSING APPARATUS FOR PCM WAVEFORM INTERPOLATION AND FILTERING

BACKGROUND OF THE INVENTION

1. Field of the Invention

The present invention relates to a tone signal processing apparatus in an electronic musical instrument and, more particularly, to a tone signal processing apparatus for reading out a PCM waveform of a tone from a waveform memory included in a PCM sound source, and performing sampling point interpolation or digital filter processing of the PCM waveform.

2. Prior Art

An electronic musical instrument of this type generally has a waveform memory corresponding to a plurality of kinds of musical instruments. The waveform memory stores waveforms in units of octaves of each instrument, and automatic accompaniment waveforms for, e.g., a chord accompaniment, a rhythm accompaniment, and the like in the form of PCM signals.

In general, an electronic musical instrument has, e.g., 16 parallel tone generation channels, and performs a maximum of 16 kinds of tone generations through these channels in correspondence with simultaneous depression of a plurality of keys and an automatic accompaniment.

A standard sampling rate of a PCM signal in one channel is, e.g., 50 kHz. PCM signals for 16 channels are time-divisionally read out from the waveform memory. A sampling rate for one channel corresponds to 800 kHz. Readout data for one channel include waveform data corresponding to two adjacent sampling points. Time-divisional data for one channel is obtained by interpolating between these two sampling points by an interpolation coefficient determined by an interval of depressed keys.

Successive 16 time-divisional data at a sampling rate of 800 kHz obtained by sampling point interpolation are accumulated by a channel accumulator to be synthesized into one tone signal at a sampling rate of 50 kHz. The tone signal includes musical tone signals for all the 16 channels, and 16 tones having 16 different tone colors can be simultaneously produced on the basis of this tone signal.

The accumulated tone signal is supplied to a digital filter before it is D/A-converted. This filter processing is performed to change tones to be produced to have brilliant or soft tone colors.

Note that Japanese patent laid-open application No. 23796/1989 discloses that the above-mentioned channel accumulator and the filter commonly use a single circuit.

In the tone signal processing apparatus, a filter used for adjusting a tone color uniformly processes an output from the channel accumulator. Therefore, different filter characteristics cannot be provided to waveform data of the respective channels.

For this reason, although after touch data common to all the depressed keys can be utilized as a filter coefficient, data such as a key velocity value corresponding to a depression pressure of each key, a key scaling value corresponding to an interval, and the like cannot be utilized as a filter coefficient.

For example, it is impossible to adjust tone colors in accordance with keyed notes (key scaling) in such a manner that brilliant tones are generated at a higher note, and soft tones are generated at a lower note. In addition, it is impossible to perform filter processing in units of channels in correspondence with parts of the channels in such a manner that brilliant tones are generated in melody channels, and bass tones are emphasized in chord or bass accompaniment channels.

In order to solve this problem, for example, the following circuit arrangement may be proposed. That is, filters having different filter coefficients are prepared in correspondence with the number of channels, and data of the respective channels obtained from the time-divisional data output from a sampling point interpolation circuit are supplied to the corresponding filters. However, in this method, filters having arrangements for directly executing formulas of the filters must be arranged in correspondence with the number of channels. For this reason, a circuit arrangement is considerably complicated, resulting in an increase in cost. Thus, such an arrangement is not practical for a simple electronic musical instrument.

SUMMARY OF THE INVENTION

It is an object of the present invention to provide a tone processing apparatus which can individually provide filter characteristics to tones in units of channels.

It is another object of the present invention to provide a tone processing apparatus which can perform a sampling point interpolation arithmetic operation and a filter arithmetic operation by a common arithmetic circuit.

According to the present invention, there is provided a tone processing circuit comprising a waveform memory for storing tone signal waveforms each consisting of tone data at a plurality of sampling points, an arithmetic circuit for multiplying each of two input data with a predetermined coefficient, and adding the products, and a memory for storing an output from the arithmetic circuit. The arithmetic circuit is alternately operated in two arithmetic modes, i.e., in an interpolation arithmetic mode for multiplying each of two tone data at adjacent sampling points, which data are read out from the waveform memory, with an interpolation coefficient, and adding the products to obtain an interpolated value obtained by interpolating between the adjacent sampling points, and in a filter arithmetic mode for multiplying the interpolated value and a previous filter output obtained from the memory with a filter coefficient, and adding the products to obtain a filter output.

The filter coefficient in the filter arithmetic mode is changed in units of channels, so that data obtained by performing filter processing of data in units of channels with different filter coefficients can be time-divisionally extracted from the common arithmetic circuit.

DETAILED DESCRIPTION OF A PREFERRED EMBODIMENT

In order to allow a better understanding of the preferred embodiment of the present invention, a prior art device will first be described.

Figure 4:
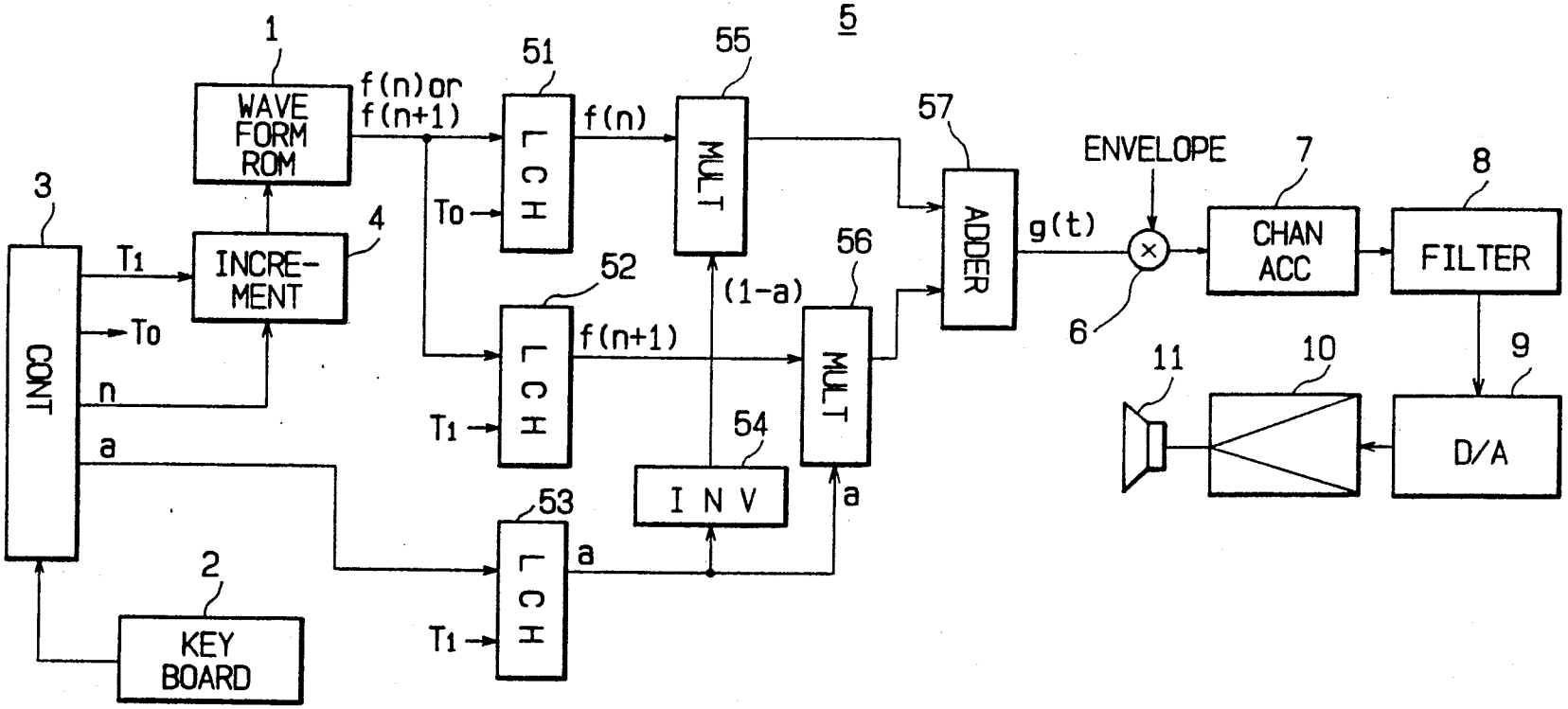
FIG. 4 is a block diagram showing a conventional tone processing apparatus.

FIG. 4 shows a tone signal processing apparatus in a conventional electronic musical instrument.

In FIG. 4, a waveform memory 1 comprising a ROM storing tone signal waveforms. The tone signal waveforms consist of N channels (e.g., N=16), each comprises tone data at n-word (e.g., n=256 words) sampling points.

For example, one of waveforms for N=16 channels is read out from the waveform memory 1 in accordance with an address n supplied from a controller 3 upon depression of a key on a keyboard 2. In this case, in order to perform sampling point interpolation (to be described later), the address n is incremented by one by an increment circuit 4 at a timing defined by a timing signal $T_1$ generated from the controller 3.

Figure 3:
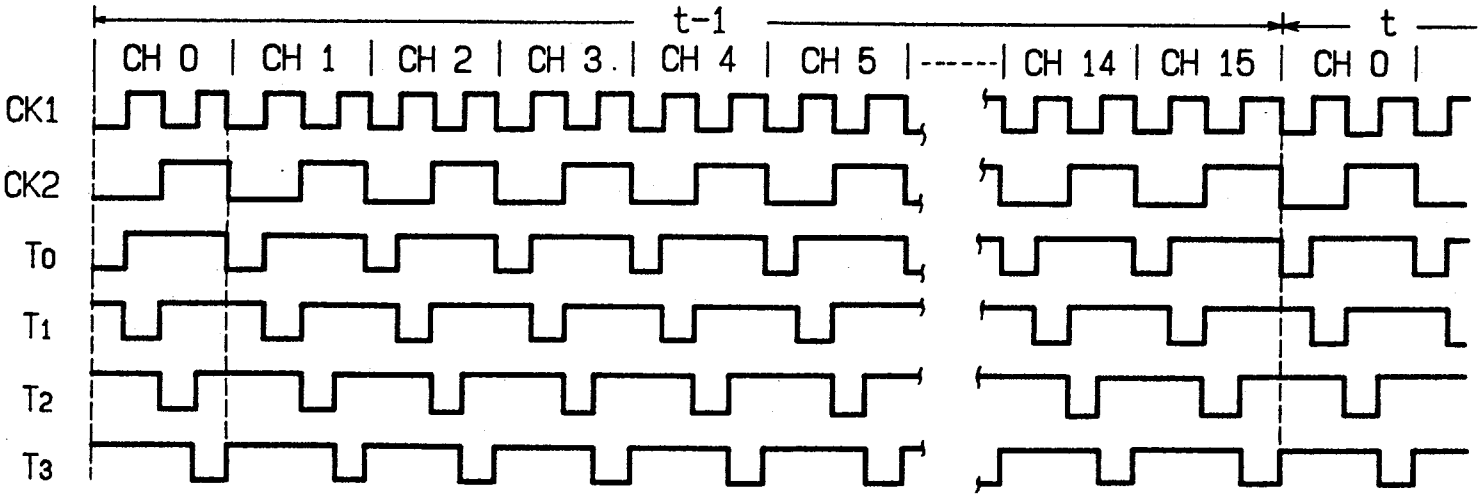
FIG. 3 is a timing chart for explaining an operation of the embodiment of the present invention, and the prior art.

For example, in the timing chart shown in FIG. 3, assuming that a reference clock is represented by CKl, 16 channels designated by CH0, CH1, CH2,..., CH15 are assigned in every two periods of the reference clock CK1. At a timing designated by $T_0$, for each channel, the address n is directly supplied to the waveform memory 1 through the increment circuit 4. At a timing $T_1$, an address (n+1) is supplied to the waveform memory 1. Thus, data at two sampling points f(n) and f(n+1) are sequentially read out from the waveform memory 1 for each channel.

The readout data are subjected to a sampling point interpolation arithmetic operation (to be described later) in a sampling point interpolation circuit 5, so that data representing sampling point interpolated values g(t) of the respective channels are time-divisionally obtained from an adder 57. The time-divisional data are modulated by an envelope signal for determining an amplitude or a decay rate of a tone waveform in a multiplier 6, and the modulated data are then supplied to a channel accumulator 7. The accumulator 7 accumulates the data of the channels CH0 to CH15 to obtain one tone signal. Thus, time-divisional data at, e.g., a sampling rate of 800 kHz are converted to data at a sampling rate of 50 kHz. The accumulated tone signal is supplied to a filter 8.

The filter 8 is used to change tones. When the accumulated tone signal passes the filter 8, tones of the respective channels are changed on the basis of common filter characteristics. The tone signal passing the filter 8 is supplied to a D/A converter 9, and is converted into an analog tone signal. The analog tone signal is amplified by an amplifier 10, and the amplified signal is supplied to a loudspeaker 11.

The above-described sampling point interpolation arithmetic operation will be described next.

Data at the adjacent sampling points f(n) and f(n+1) for each channel are read out from the waveform memory 1, and are supplied to the sampling point interpolation circuit 5. The sampling point interpolation circuit 5 performs arithmetic processing given by the following equation to calculate a sampling point interpolated value g(t):

$$\begin{aligned} g(t) &= \{f(n+1)-f(n)\}*a+f)n) \\ &= f(n)*(1-a)+f(n+1)*a \end{aligned} \quad (1)$$

for $0 \leqq a < 1$ where n is the integral part of a waveform read address;

a is the decimal part of the waveform read address (interpolation coefficient); and g(t) is the sampling point interpolated value at time t.

The sampling point interpolation circuit 5 shown in FIG. 4 executes the arithmetic operation given by equation (1).

Of the data f(n) and f(n+1) read out from the waveform memory 1, the data f(n) is latched by a latch circuit 51 at the timing $T_0$, and the next data f(n+1) is latched by a latch circuit 52 at the timing $T_1$. On the other hand, an address decimal part a generated by the controller 3 and corresponding to the interpolation coefficient is latched by a latch circuit 53 at the timing $T_1$ in units of channels. The decimal part a is inverted to (1−a) by an inverter 54, and (1−a) is multiplied with an output f(n) from the latch circuit 51 by a multiplier 55. In addition, the decimal part a is multiplied with an output f(n+1) from the latch circuit 52 by a multiplier 56. Therefore, f(n)*(1−a) of equation (1) is obtained by the multiplier 55, and f(n+1)*a of equation (1) is obtained by the multiplier 56. The outputs from these multipliers 55 and 56 are added to each other by the adder 57, thereby obtaining the sampling point interpolated value g(t).

The number of interpolation points per unit time is determined by the address decimal part supplied from the controller 3 in accordance with a tone pitch of a key. For example, when a=0.2, the address integral part n for the waveform memory is incremented by one by five interpolations, and four interpolation data are formed during one sampling interval.

In the tone signal processing apparatus shown in FIG. 4, the filter 8 for changing a tone color is arranged at the output side of the channel accumulator 7, as described above. Therefore, the filter 8 performs filter processing using a common filter coefficient for data of all the channels. Thus, a tone color cannot be changed in units of channels.

The principle of the present invention which can perform filter processing in units of channels will be described below.

In the present invention, as an equation for a filter, the following equation (2) is used.

$$\begin{aligned} G(t) &= \{g(t)-G(t-1)\}*b+G(t-1) \\ &= G(t-1)*(1-b)+g)t)*b \end{aligned}$$

For $0 < b \leqq 1$ where

G(t−1) is the sampling point interpolated value after a previous filter arithmetic operation (previous filter output);

g(t) is the sampling point interpolated value before the present filter arithmetic operation;

b is the filter coefficient; and

G(t) is the filter output.

Equation (2) is similar in form to equation (1) for the sampling point interpolation described above.

Figure 2:
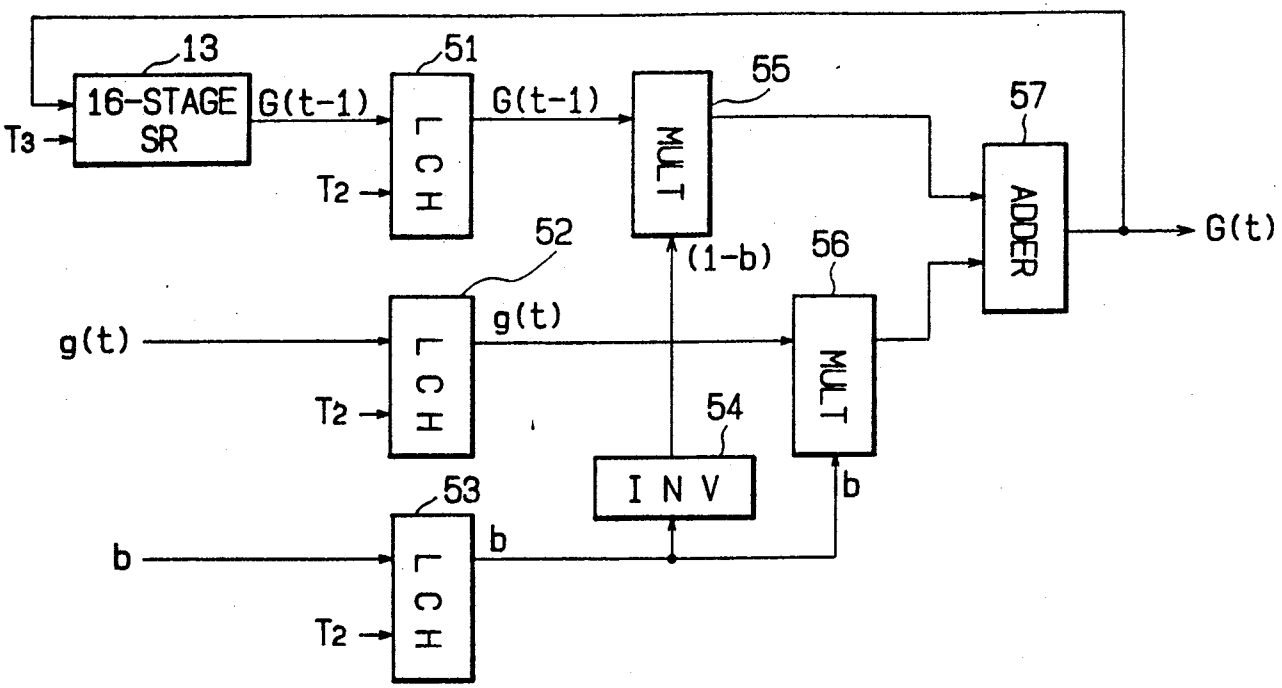
FIG. 2 is a block diagram showing an embodiment of a filter circuit based on a filter formula used in the present invention.

FIG. 2 shows a filter circuit for executing equation (2). In FIG. 2, the same reference numerals denote parts having the corresponding functions in the sampling point interpolation circuit 5 shown in FIG. 4.

In FIG. 2, filter outputs G(t) are obtained in the order of CH0 to CH1, and are sequentially stored in a 16-stage shift register 13. The shift register 13 is subjected to read access at a timing $T_3$ shown in FIG. 3. Therefore, the readout filter outputs G(t) serve as previous filter outputs G(t−1) in equation (2). The present sampling point interpolated value g(t) is latched by a latch circuit 52 at a timing $T_2$ shown in FIG. 3.

On the other hand, the filter coefficient b is latched by a latch circuit 53 in units of channels at the timing $T_3$. The filter coefficient b is inverted to (1−b) by an inverter 54, and (1−b) is multiplied with an output G(t−1) from a latch circuit 51 by a multiplier 55. In addition, the filter coefficient b is multiplied with the output g(t) from the latch circuit 52 by a multiplier 56. Therefore, G(t−1)*(1−b) of equation (2) is obtained from the multiplier 55, and g(t)*b of equation (2) is obtained from the multiplier 56. The outputs from these multipliers 55 and 56 are added to each other by an adder 57, thus obtaining the filter output G(t). Therefore, the filter coefficient b is determined in units of channels, so that tones can be filtered in units of channels.

As described above, the filter shown in FIG. 2 and the sampling point interpolation circuit 5 shown in FIG. 4 have substantially the same arrangement. Therefore, a filter arithmetic operation and a sampling point interpolation arithmetic operation are time-divisionally performed using a common circuit arrangement.

Figure 1:
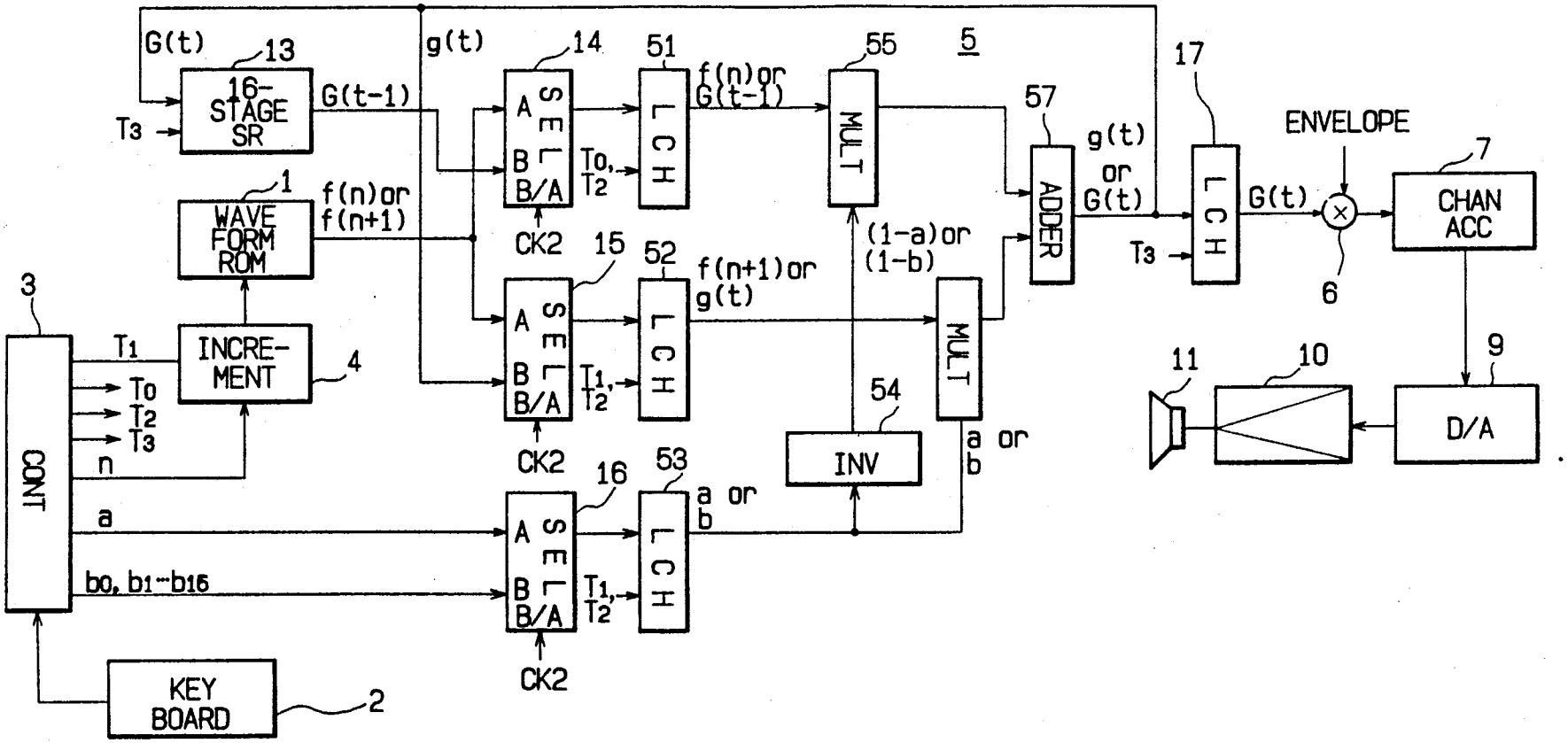
FIG. 1 is a block diagram showing an embodiment of the present invention.

FIG. 1 shows an embodiment of the present invention based on the above-mentioned principle, and the same reference numerals denote corresponding parts in FIGS. 2 and 4.

In this embodiment, the filter 8 shown in FIG. 4 is omitted, and the latch circuits 51, 52, and 53, the inverter 54, the multipliers 55 and 56, and the adder 57 shown in FIGS. 2 and 4 are commonly used as a filter circuit and a sampling point interpolation circuit. Therefore, the adder 57 alternately outputs a sampling point interpolated value g(t) and a filter output G(t). 2-input selectors 14, 15, and 16 are arranged to perform this time-divisional processing. Inputs A of the selectors 14 and 15 receive data f(n) and f(n+1) read out from the waveform memory 1. An input B of the selector 14 receives a previous filter output G(t−1) from the shift register 13, and an input B of the selector 15 receives a sampling point interpolated value g(t) from the adder 57. An input A of the selector 16 receives the interpolation coefficient a from the controller 3, and its input B receives filter coefficients $b_0$, $b_1$, $b_2$,..., $b_{15}$ generated in the order of channels from the controller 3. In order to perform a sampling point interpolation arithmetic operation in the first half of a clock CK2 shown in FIG. 3, these selectors 14, 15, and 16 allow f(n) and f(n+1), and a at their inputs A to pass therethrough. In order to perform a filter arithmetic operation in the second half of the clock CK2, these selectors allow G(t−1), g(t), and b ($b_0$ to $b_{15}$) at their inputs B to pass therethrough.

In the sampling point interpolation arithmetic mode, the latch circuit 51 latches the data f(n) at the timing $T_0$, and supplies it to the multiplier 55. The latch circuit 52 latches the data f(n+1) at the timing $T_1$, and supplies it to the multiplier 56. Furthermore, the latch circuit 53 latches the address decimal part interpolation coefficient) a at the timing $T_1$, and supplies it to the inverter 54. Thus, the sampling point arithmetic operation given by equation (1) described above with reference to FIG. 4 is performed, and a sampling point interpolated value g(t) can be obtained from the adder 57.

In the filter arithmetic mode, the latch circuit 51 latches the data G(t−1) at the timing $T_2$, and supplies it to the multiplier 55. The latch circuit 52 latches the data g(t) at the timing $T_2$, and supplies it to the multiplier 56. Furthermore, the latch circuit 53 latches the filter coefficient b at the timing $T_2$, and supplies it to the inverter 54. Thus, the filter arithmetic operation given by equation (2) described above with reference to FIG. 2 is performed, and the filter output G(t) can be obtained from the adder 57.

The output G(t) from the adder 57 is latched by a latch circuit 17 at the timing $T_3$ shown in FIG. 3. Therefore, outputs G(t) from the latch circuit 17 correspond to time-divisional data including data in the order of channels obtained by performing the filter processing of the sampling point interpolated values g(t) of the respective channels in accordance with the filter coefficients $b_0$ to $b_{15}$ determined in units of channels.

The time-divisional data are supplied to a channel accumulator 7, and are accumulated in units of periods indicated by (t−1) and (t) in FIG. 3. Thereafter, the accumulated data is converted into an analog tone signal by a D/A converter 9. The converted signal is then amplified by an amplifier 10, and the amplified signal is supplied to a loudspeaker 11.

Therefore, the filter coefficients $b_0$ to $b_{15}$ are changed in accordance with key ON events of a keyboard 2, thus changing tone colors of tones in units of channels. In this case, the filter coefficients $b_0$ to $b_{15}$ can be changed in accordance with key velocities (key ON speeds) or key scaling of individual keys.

According to the present invention, when a filter equation similar to the conventional sampling point interpolation equation is used, the sampling point interpolation circuit and the filter circuit are constituted by a common arithmetic circuit. In this arithmetic circuit, the sampling point interpolation arithmetic operation and the filter arithmetic operation are time-divisionally performed. For this reason, filter coefficients in units of channels can be set for tone data for a plurality of channels read out from the waveform memory, and tones can be changed in units of tones of respective channels. Therefore, filter coefficients can be selected in accordance with key velocity or key scaling data, so that tones can be changed in accordance with touch data of each key. As a result, the degree of freedom of the filter processing can be greatly increased as compared to a conventional apparatus.

What is claimed is:

1. A tone processing circuit comprising:

a waveform memory for storing a tone signal waveform including tone data at a plurality of sampling points;

an arithmetic circuit for multiplying each of two adjacent sampling points with a predetermined coefficient, and adding the products to produce an output; and a memory circuit for storing the output from said arithmetic circuit, wherein said arithmethic circuit is alternately operated in two arithmetic modes including, an interpolation arithmetic mode for multiplying each of the two adjacent sampling points read out from said waveform memory with an interpolation coefficient, and adding the products to obtain an interpolated value obtained by interpolating between the two adjacent sampling points, and a filter arithmetic mode for multiplying the interpolated value and a previous filter output obtained from said memory circuit with a filter coefficient, and adding the products to obtain a filter output, said waveform memory having memory areas for a plurality of channels which respectively store a plurality of different tone signal waveforms, wherein the plurality of different tone signal waveforms of the plurality of channels are time-divisionally read out, the filter coefficient varying for each of the plurality of channels.

2. The circuit according to claim 1, wherein the interpolated value is calculated by $$g(t)=f(n)*(1-a)+f(n+1)*a$$

where f(n) and f(n+1) are the two adjacent sampling points of tone data, n is an integral address part, a is a decimal address part representing the interpolation coefficient where $0 \leqq a < 1$, and g(t) is the interpolated value, and the filter output is calculated by $$G(t)=G(t-1)*(1-b)+g(t)*b$$

where G(t−1) is the previous filter output, g(t) is the interpolated value, and b is the filter coefficient where $0 < b \leqq 1$.

3. The circuit according to claim 1, further comprising:

a selection circuit for selecting, in the interpolation arithmetic mode, the two adjacent sampling points read out from said waveform memory, and the interpolation coefficient, and in the filter arithmetic mode, the interpolated value, the previous filter output obtained from said memory circuit, and the filter coefficient.

4. The circuit according to claim 1, said arithmetic circuit including:

first and second multipliers, and an adder for adding outputs from said multipliers, such that in the interpolation arithmetic mode, said first multiplier multiples one of the two adjacent sampling points read out from said waveform memory with the interpolation coefficient, and said second multiplier multiples the other one of the two adjacent sampling points read out from said waveform memory with an inverse of the interpolation coefficient; and in the filter arithmetic mode, said first multiplier multiplies the interpolated value with the filter coefficient, and said second multiplier multiplies the previous filter output obtained from said memory circuit with an inverse of the filter coefficient.

5. The circuit according to claim 4, further comprising an inverter for outputting the inverse of the interpolation and the filter coefficients on the basis of the interpolation coefficient and the filter coefficient.

6. A tone signal processing apparatus comprising:

an arithmetic circuit including, sampling point interpolation means for performing a sampling point interpolation arithmetic operation utilizing a predetermined equation for tone data read out from a waveform memory and for storing a tone signal waveform consisting of tone data at a plurality of sampling points, and filter means for performing a filter arithmetic operation utilizing an equation for adding, to a previous filter output value, a value obtained by multiplying a difference between a sampling point interpolated value obtained from said sampling point interpolation means and a previous filter output value with a predetermined filter coefficient, wherein said arithmetic circuit time-divisionally performs the sampling point interpolation arithmetic operation and the filter arithmetic operation, said waveform memory having memory areas for a plurality of channels, which respectively store a plurality of different tone signal waveforms, wherein the plurality of different tone signal waveforms of the plurality of channels are time-divisionally read out, the filter coefficient varying for each of the plurality of channels.

7. The circuit according to claim 6, wherein the sampling point interpolation arithmetic operation is calculated by $$g(t)=f(n)*(1-a)+f(n+1)*a$$

where f(n) and f(n+1) are adjacent sampling points of tone data, n is an integral address part, a is a decimal address part representing an interpolation coefficient where $0 \leqq a < 1$, and g(t) is the sampling point interpolated value, and the filter arithmetic operation is calculated by $$G(t)=G(t-1)*(1-b)+g(t)*b$$

where G(t−1) is a previous filter output, g(t) is the sampling point interpolated value, and b is a filter coefficient where $0 < b \leqq 1$.

8. A tone processing circuit comprising:

waveform memory means for storing a plurality of waveforms, each waveform including a plurality of sampling points;

addressing means, responsive to key information for generating successive addresses, including an integral address part and a decimal address part, wherein the integral address part is used to read tone data representative of the plurality of stored waveforms of said waveform memory means;

arithmetic means for performing sampling point interpolation on the plurality of stored waveforms using the decimal address part as a first coefficient for the tone data read from said waveform memory means to generate interpolated tone data;

time-divisional means for operating said arithmetic means as a tone filter for performing a filter arithmetic operation on the plurality of stored waveforms using a second coefficient in place of said first coefficient;

channel means, including a plurality of channels for outputting the plurality of interpolated and filtered waveforms through said arithmetic means, wherein said plurality of interpolated and filtered waveforms are time-divisionally output and said second coefficient varies for each of the plurality of channels;

accumulation means for accumulating said plurality of interpolated and filtered waveforms in said plurality of channels to generate accumulated waveform data; and conversion means for converting said plurality of accumulated waveform data into an analog tone signal.

9. The tone processing circuit of claim 8, wherein said second coefficient is responsive to key scale data generated by a keyboard operation.

10. The tone processing circuit of claim 8, wherein said second coefficient is responsive to key touch data generated by a keyboard operation.

* * * * *